US006677915B1

(12) United States Patent
Yablonovitch et al.

(10) Patent No.: US 6,677,915 B1
(45) Date of Patent: Jan. 13, 2004

(54) SHIELDED SPIRAL SHEET ANTENNA STRUCTURE AND METHOD

(75) Inventors: Eli Yablonovitch, Malibu, CA (US); Laurent Desclos, Los Angeles, CA (US); Sebastian Rowson, Santa Monica, CA (US)

(73) Assignee: Ethertronics, Inc., San Diego, CA (US)

( * ) Notice: Subject to any disclaimer, the term of this patent is extended or adjusted under 35 U.S.C. 154(b) by 254 days.

(21) Appl. No.: 09/781,780

(22) Filed: Feb. 12, 2001

(51) Int. Cl.[7] ..... H01Q 11/14
(52) U.S. Cl. ..... 343/841; 343/744
(58) Field of Search ..... 343/841, 700 MS, 343/702, 895, 732, 741, 842, 866, 744; 455/90

(56) References Cited

U.S. PATENT DOCUMENTS

| | | | | |
|---|---|---|---|---|
| 3,648,172 A | | 3/1972 | Nakahara et al. | 324/51 |
| 3,845,487 A | | 10/1974 | Lammers | 343/113 DE |
| 4,328,502 A | | 5/1982 | Scharp | 343/771 |
| 4,598,276 A | | 7/1986 | Tait | 340/572 |
| 5,184,144 A | | 2/1993 | Thombs | 343/781 R |
| 5,337,065 A | | 8/1994 | Bonnet et al. | 343/767 |
| 5,726,666 A | | 3/1998 | Hoover et al. | 343/770 |
| 5,754,143 A | | 5/1998 | Warnagirls et al. | 343/767 |
| 5,764,190 A | * | 6/1998 | Murch et al. | 343/702 |
| 5,781,158 A | * | 7/1998 | Ko et al. | 343/700 MS |
| 5,790,080 A | * | 8/1998 | Apostolos | 343/744 |
| 5,900,843 A | | 5/1999 | Lee | 343/767 |
| 5,936,583 A | | 8/1999 | Sekine et al. | 343/702 |
| 6,008,764 A | * | 12/1999 | Ollikainen et al. | 343/700 MS |
| 6,046,707 A | | 4/2000 | Gaughan et al. | 343/895 |
| 6,246,371 B1 | | 6/2001 | Kurz et al. | 343/702 |
| 6,339,409 B1 | | 1/2002 | Warnagiris | 343/895 |
| 6,369,777 B1 | | 4/2002 | Ohara et al. | 343/895 |

OTHER PUBLICATIONS

Sievenpiper, D., Zhang, L; Broas, Romulo F. Jimenez; Alexopolous, Nicholas G.; Yablonovitch, Eli. High Impedance Electromagnetic Surfaces with a Forbidden Frequency Band IEEE Transactions on Microwave Theory and Techniques, vol. 47, No. 11, Nov., 1999.

Wheeler, Harold A., Small Antennas, IEEE Transactions on Antennas and Propagation. Jul. 1975.

Sievenpiper, et al., "High–impedance electromagnetic surfaces with a forbidden frequency band." IEEE Transactions on Microwave Theory and Techniques, 47(11):2059–2074, 1999.

International Search Report from PCT Application No. PCT/US02/04228.

* cited by examiner

*Primary Examiner*—James Clinger
(74) *Attorney, Agent, or Firm*—Foley & Lardner

(57) ABSTRACT

The shielded spiral sheet antenna concept permits a small efficient antenna structure that is much smaller than the electromagnetic wavelength. In such small structures, the radiation usually goes almost all directions. A geometrical structure that shields the radiation from absorbers, and it directs the radiation in the opposite direction. This is difficult to achieve in very small radiators. At the same time, the shielded spiral sheet structure is more efficient than other antennas. Its radiation is shielded from an adjacent absorber by an asymmetric metallic border. The specifications of the asymmetric metallic border are given by an operational mathematical procedure.

9 Claims, 19 Drawing Sheets

SHIELDED SPIRAL SHEET ANTENNA STRUCTURE AND METHOD

CROSS REFERENCE TO RELATED APPLICATIONS

This application relates to concurrently filed, co-pending application U.S. patent application Ser. No. 09/781,720, entitled "Magnetic Dipole Antenna Structure and Method" by Eli Yablonovitch et al., owned by the assignee of this application and incorporated herein by reference.

This application relates to concurrently filed, co-pending application U.S. patent application Ser. No. 09/781,779, entitled "Spiral sheet Antenna Structure and Method" by Eli Yablonovitch et al., owned by the assignee of this application and incorporated herein by reference.

This application relates to concurrently filed, co-pending application U.S. patent application Ser. No. 09/781,723, entitled "Internal Circuit Board in an Antenna Structure and Method Thereof" by Eli Yablonovitch et al., owned by the assignee of this application and incorporated herein by reference.

BACKGROUND INFORMATION

1. Field of the Invention

The present invention relates generally to the field of wireless communication, and particularly to the design of an antenna on a wireless device.

2. Description of Related Art

In portable wireless communications, the radio transceiver needs to work adjacent to a radio absorber, like the human body, or like a laptop computer that has radio absorbing components. Because of this absorption, energy is wasted, and the radio transceiver is often less than 50% efficient. This means that the talk time of a cellphone can be increased by making the antenna more efficient. Alternately, the battery can be reduced in size, saving cost and weight. Similarly in receive mode, the antenna will receive more radio energy, and there will be fewer dropped calls in poor coverage areas, and in buildings. In addition, there has been speculation for some time that the radio energy absorbed in the body might be producing health effects. Accordingly, there is a need to provide effective shielding between the antenna and the absorber.

SUMMARY OF THE INVENTION

The invention discloses a metallic border that has a width comparable to the thickness of a spiral sheet antenna which provides an effective shield, as measured by the front-to-back radiation ratio. The spiral sheet antenna structure can be readily shielded from an absorber on one side by providing a metallic border, asymmetrically on one face of the spiral sheet antenna. For example a front-to-back ratio of 5 dB can be achieved by an asymmetric shield structure. The form of asymmetric structure is mathematically and geometrically specified by a geometrical procedure. Significantly, two holes or openings are asymmetrically placed so that they tend to face in the same direction, and away from the absorber. In one embodiment, both openings are facing in the same direction.

Advantageously, the present invention provides a shield to block radio energy from being absorbed in a body, which potentially could be harmful to a person's health. The present invention also designs an antenna structure in which radio energy tends to flow in the direction away from a person.

Other structures and methods are disclosed in the detailed description below. This summary does not purport to define the invention. The invention is defined by the claims.

BRIEF DESCRIPTION OF THE DRAWINGS

FIG. 12B is a side cross-section view showing the path 128–129 followed by magnetic field lines B.

DETAILED DESCRIPTION OF PREFERRED EMBODIMENT(S)

Figure 1:
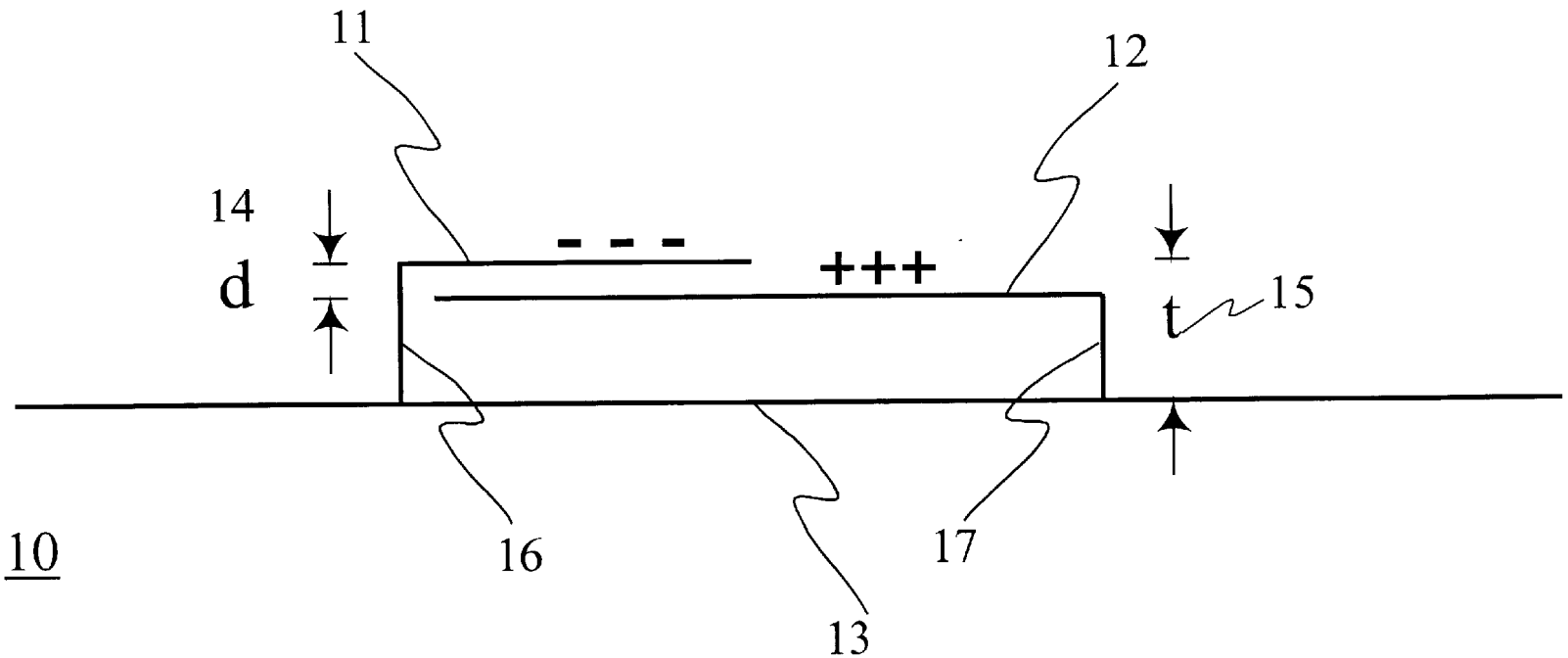
FIG. 1 is a pictorial diagram illustrating a cross-sectional view of a spiral sheet antenna for producing a spiral sheet current distribution in accordance with the present invention. The overlapping plates 11 and 12 form a seam between the two openings at the ends.

FIG. 1 is a pictorial diagram illustrating a cross-sectional view of a spiral sheet antenna 10, resembling a rectangular cylindrical shape, with two holes at the ends, and a capacitive seam connecting the two holes, for producing a cylindrical current distribution. The spiral sheet antenna 10 can constructed with three plates, a first plate 11, a second plate 12, and a third plate 13. The variable d 14 represents the spacing between the first plate 11 and the second plate 12, and the variable t 15 represents the thickness of all three plates. A vertical connection 16 connects between the third plate 13 and the first plate 11, while the third plate 13 connects to the second plate 12 via a vertical connection 17. The length of the third plate 13, between vertical connections 16 and 17 is selected to be less than a quarter wavelength, $\lambda/4n$, where n is the square root of the dielectric constant.

The structure of the spiral sheet antenna 10 increases the effective dielectric constant by a factor of t/d. Effective increase in capacitance is due to overlapping plates between the plate 11 and the plate 12. In effect, the spiral antenna 10 produces a large dielectric constant, without the need for a high dielectric constant material, just from is electrode geometry alone, i.e. $\in_{relative}$=t/d. Effectively, treating the spiral sheet antenna as a patch type antenna, the required length of the patch then becomes $$a = \frac{\lambda}{4}\sqrt{\frac{d}{t}} \times \frac{1}{\sqrt{\varepsilon_r}},$$

where $\in_r$ is the relative dielectric constant of the capacitor dielectric.

Figure 2A:
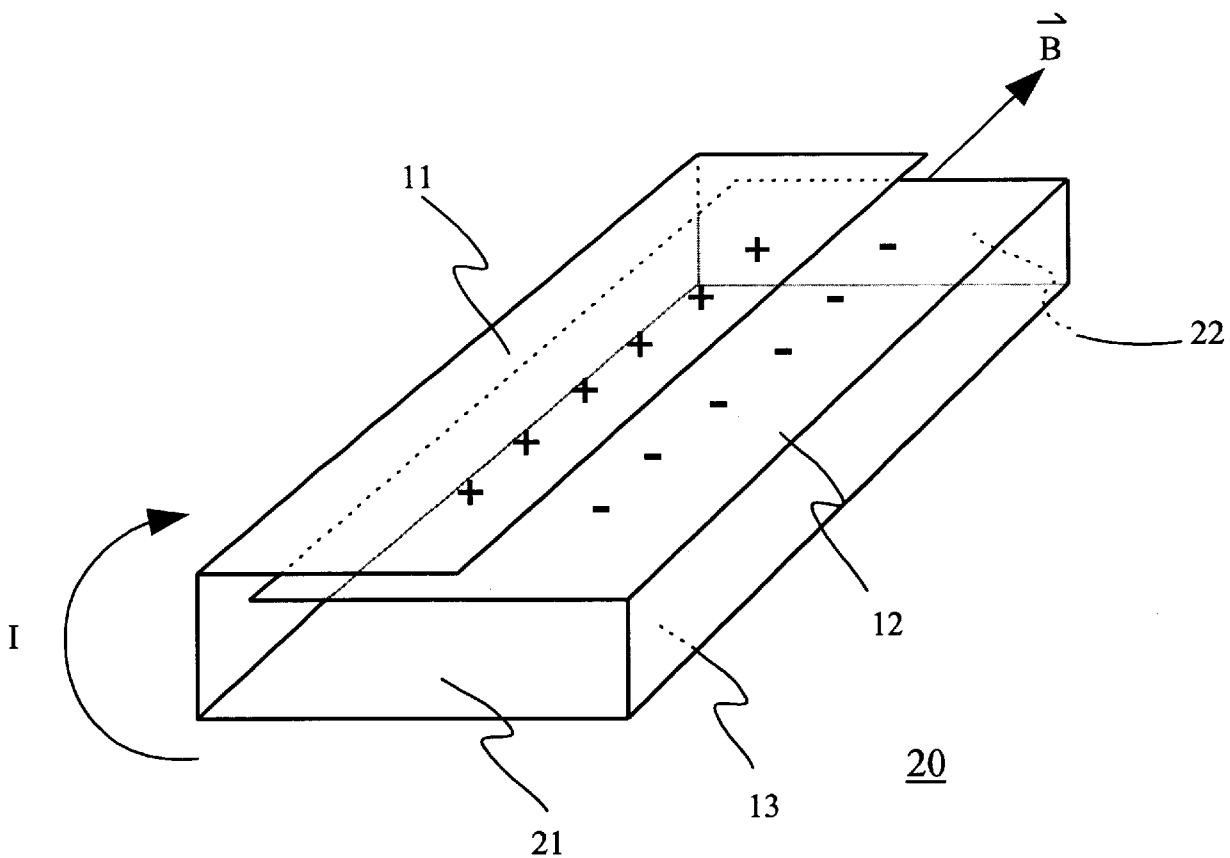
FIGS. 2A–2B are pictorial diagrams illustrating a perspective view of two similar antenna structures having different aspect ratio in length and width, respectively, of a spiral sheet antenna for producing a spiral sheet current distribution in accordance with the present invention.

FIGS. 2A is a pictorial diagram illustrating a perspective view of a spiral sheet antenna 20 for producing a cylinder-like current distribution. The spiral sheet antenna 20 has a first hole 21 and a second hole 22, at the ends, and a capacitive seam connecting the two holes. The alternating current (AC) magnetic field vector $\overline{B}$, is shown entering hole 21 and exiting hole 22.

Figure 2B:
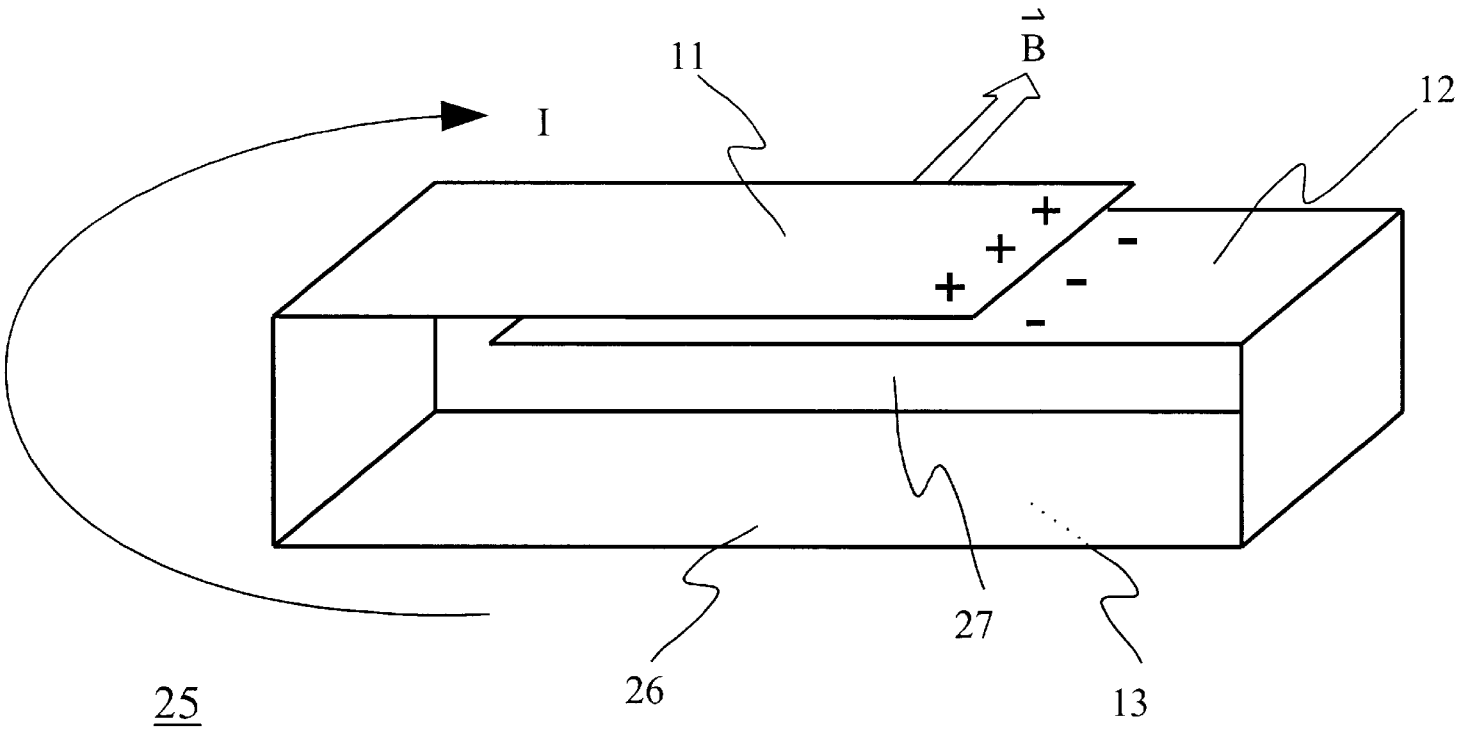

FIG. 2B is a pictorial diagram illustrating a spiral sheet antenna 25 for producing a cylinder-like current distribution with a different aspect ratio, with a first hole 26 and a second hole 27. The structure shape in FIG. 2B is the same as the structure shape in FIG. 2A. However, the aspect ratio, in FIG. 2B, is different from the aspect ratio in FIG. 2A. The curved vector I represents the general direction of the AC currents.

The spiral antennas 20 and 25 in FIGS. 2A and 2B operate like a single-turn solenoids. A single-turn solenoid consists of a cylinder-like current distribution. A significant portion of the electromagnetic radiation produced by the spiral antennas 20 and 25 arises from the alternating current (AC) magnetic field vector $\overline{B}$ that enters and exits from the holes at the end of the single turn solenoid.

Advantageously, the antennas 20 and 25 do not require a high dielectric constant ceramic to attain a small dimensional size. The inherent capacitance in the structure of the antennas 20 and 25 allows a low frequency operation according to the formula:

$$\omega = \frac{1}{LC},$$

where ω is the frequency in radians/second, L is the inductance of the single turn solenoid formed by 11, 16, 13, 17 and 12 in FIG. 1., and C is the capacitance from the thin overlapping region labeled as the thickness d 15, or the spacing 14.

Figure 3:
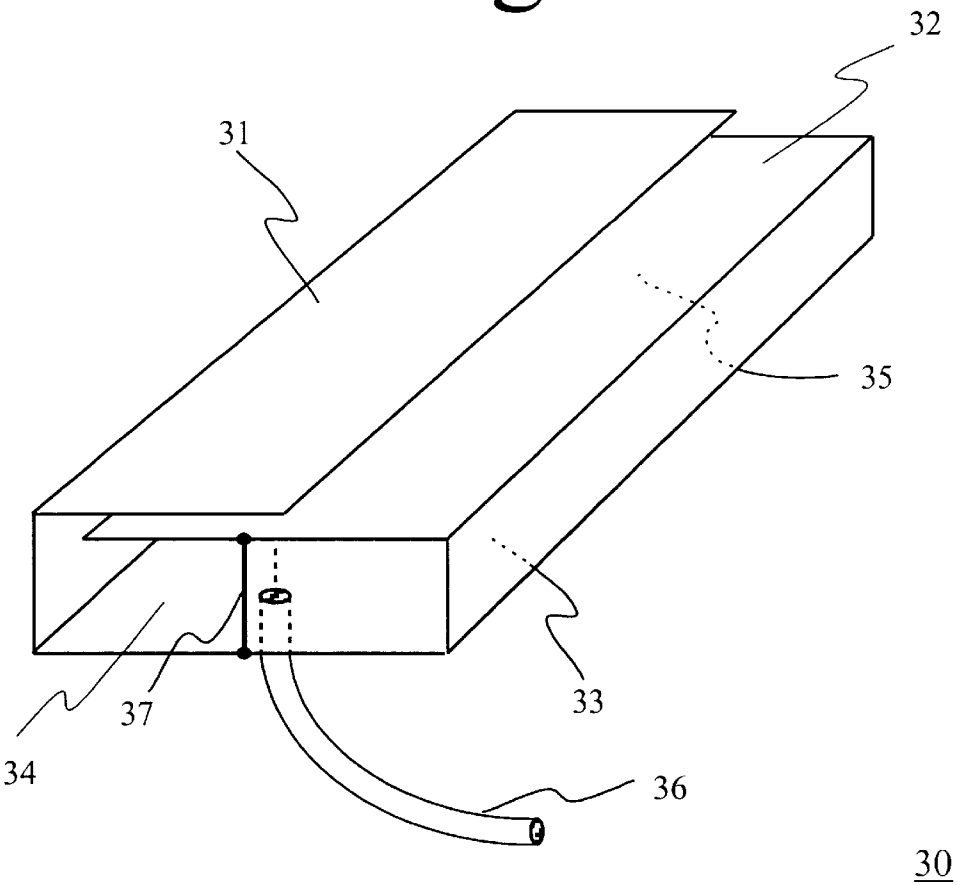
FIG. 3 is a pictorial diagram illustrating a first possible drive configuration for a spiral sheet antenna in accordance with the present invention.

FIG. 3 is a pictorial diagram illustrating a first drive or feed configuration 30 for a spiral sheet antenna producing a cylindrical current distribution. The first drive configuration 30 has a first plate 31, a second plate 32, a third plate 33, a first hole 34, and a second hole 35. A drive cable 36 attaches and drives the spiral sheet antenna 20. In this embodiment, the co-axial drive cable 36 matches any desired input impedance. An optional vertical short circuit wire, 37, can assist in providing an impedance matching shunt to the spiral sheet antenna 20.

Figure 4:
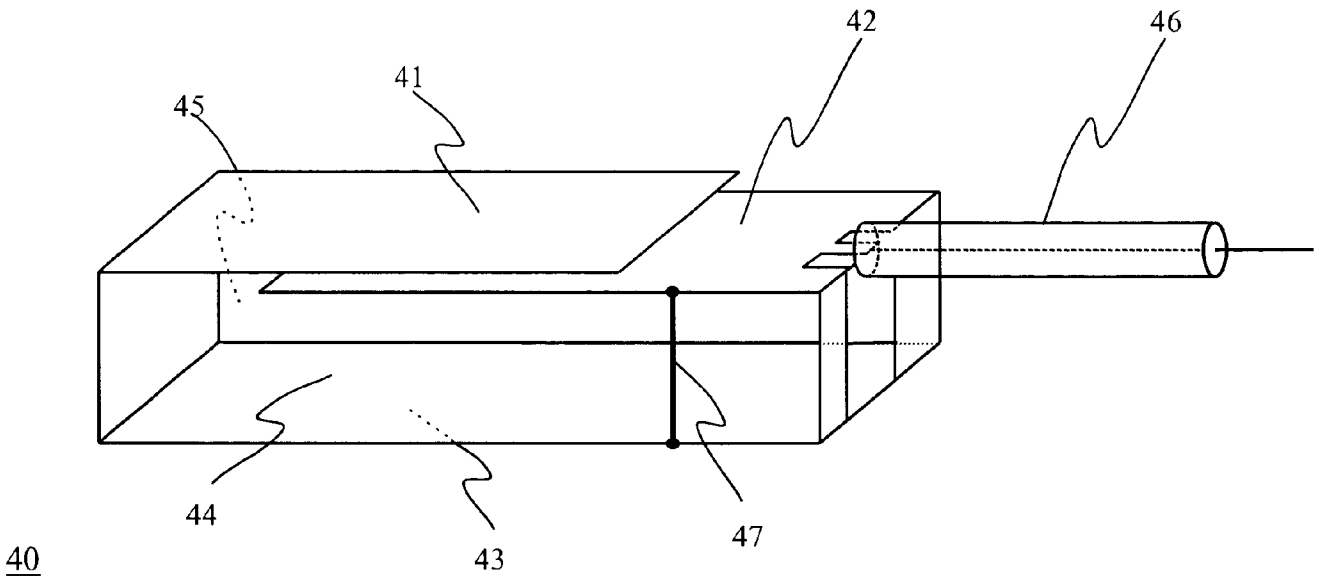
FIG. 4 is a pictorial diagram illustrating a second possible drive configuration for a spiral sheet antenna in accordance with the present invention.

FIG. 4 is a pictorial diagram illustrating a second drive configuration 40 of a spiral sheet antenna for producing a rectangular cylinder-like current distribution. The second drive configuration 40 has a first plate 41, a second plate 42, a third plate 43, a first hole 44, and a second hole 45 at the rear opening of the rectangular cylinder. A feed or drive cable 46 attaches and drives the spiral sheet antenna 20, with an optional impedance matching vertical shunt wire 47 connecting between the second plate 42 and the third plate 43. Preferably, the material used to construct an antenna might have a high electrical conductivity, e.g. copper depending on the required antenna Q-factor.

FIGS. 3 and 4 illustrate two sample drive configurations applied to the spiral sheet antenna 20, and are not meant to be an exhaustive listing since many possibilities abound. One of ordinary skill in the art should recognize that there are numerous other similar, equivalent, or different drive configurations that can be practiced without departing from the spirit of the present invention. A spiral sheet antenna 20 produces an AC magnetic field that radiates efficiently in a structure that is smaller than $$\frac{\lambda}{4\sqrt{\varepsilon_r}},$$

that is a typical restriction for a patch antenna, where λ is the electromagnetic wavelength in vacuum, and $\sqrt{\in_r}$ is the microwave refractive index.

The antenna being described here can be regarded as a rectangular metallic enclosure with two openings, (at the ends of the rectangle), and a seam connecting the two holes. The seam functions as a capacitor and can be implemented in several different ways. First, the seam can be constructed as an overlapping region as shown in 20.

Second, a seam can be constructed as slot between to metal sheets as shown in 80, where two edges meet. Third, a seam can be constructed with a slot under which there is an additional metal sheet underneath as shown in 60.

Figure 5:
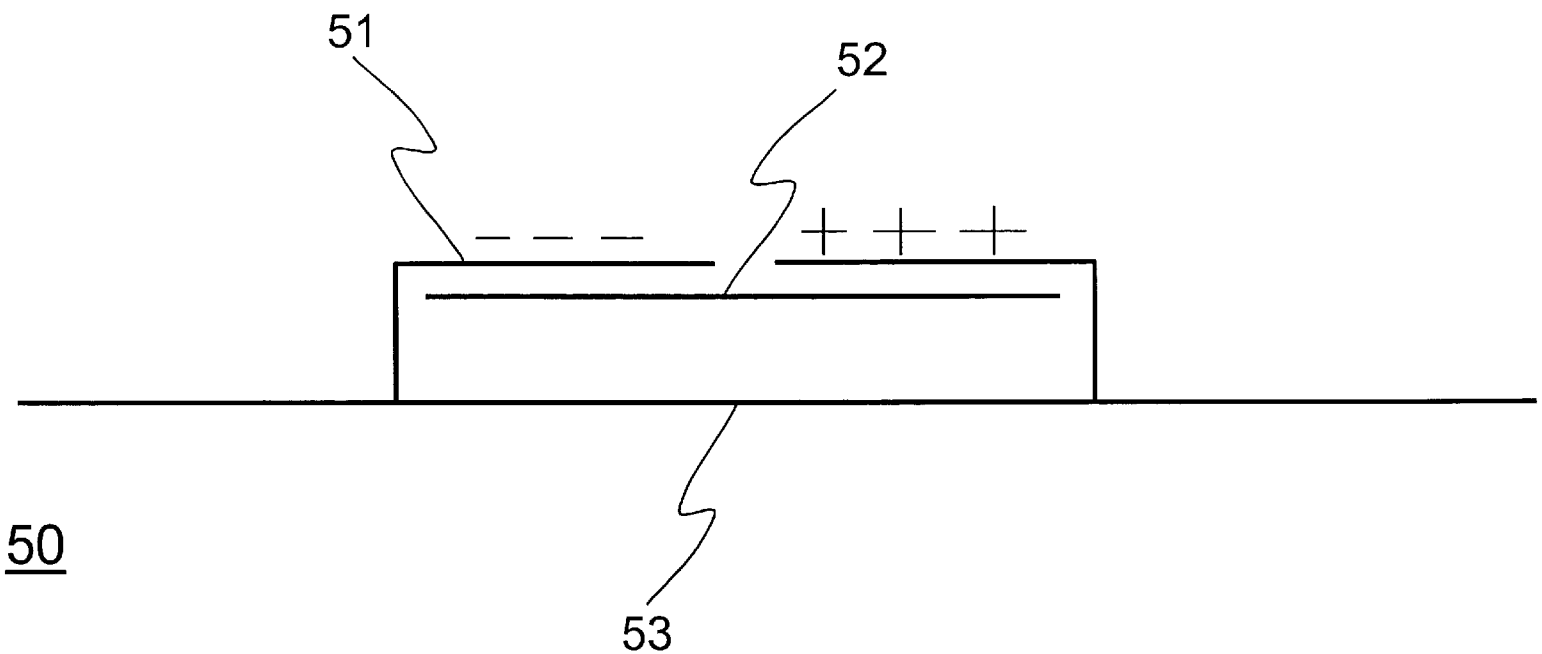
FIG. 5 is a pictorial diagram illustrating a first embodiment of a cylinder-like antenna having two holes at the ends, with a seam between the two holes for producing a circular current distribution with a double parallel plate in accordance with the present invention.

FIG. 5 is a pictorial diagram 50, illustrating a first embodiment of a rectangular cylindrical sheet antenna with an opening at each end of the rectangular cylinder, and with a seam connecting the two holes at the ends. The seam consists of a slot over a double parallel plate. The rectangular cylindrical current distribution structure 50 has a second plate 52 overlapping with a first plate 51 in two areas on either side of the slot or seam to provide capacitance. The third plate 53 is far from the first and second plates 51 and 52, and therefore contributes little to the capacitance. The rectangular cylindrical current distribution structure 50 thus yields the benefit of a large dielectric constant, without the need for a special dielectric material. However, the capacitance is diminished is by a factor 4 due to the two capacitors in series from the overlap of the first and second plates 51 and 52, compared to the same two plates in parallel.

Figure 6:
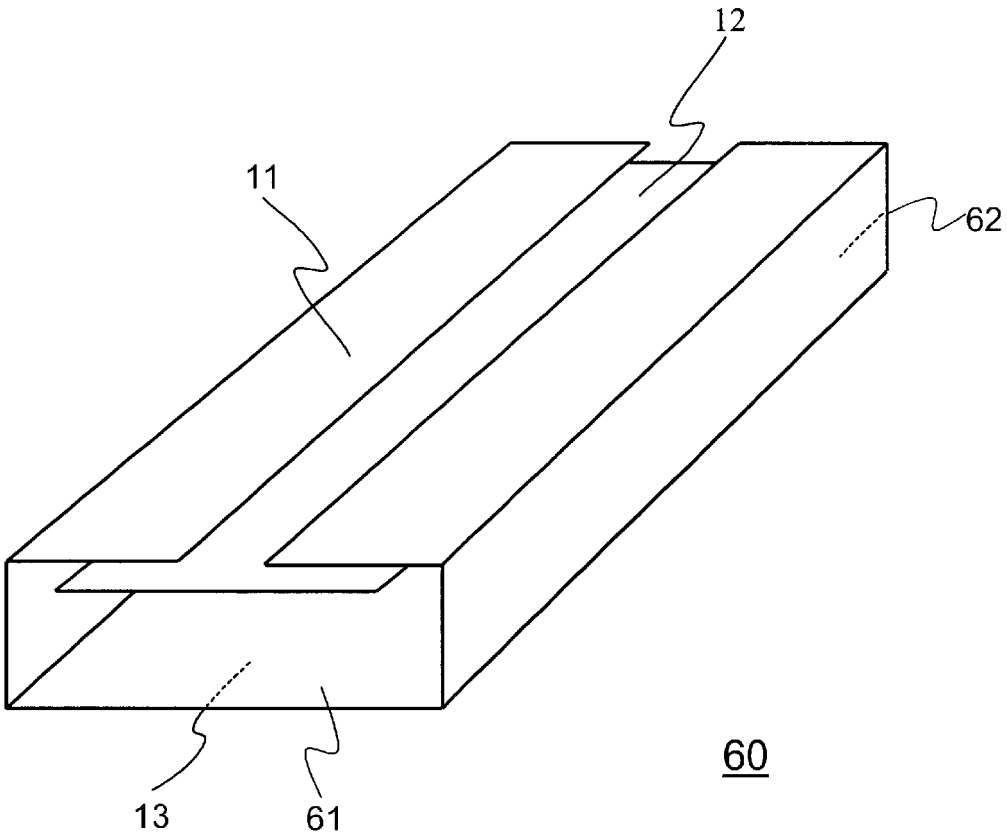
FIG. 6 is a pictorial diagram illustrating a perspective view of a cylinder-like antenna having two holes at the ends, with a seam between the two holes for producing a circular current distribution with a double parallel plate in accordance with the present invention.
Figure 7A:
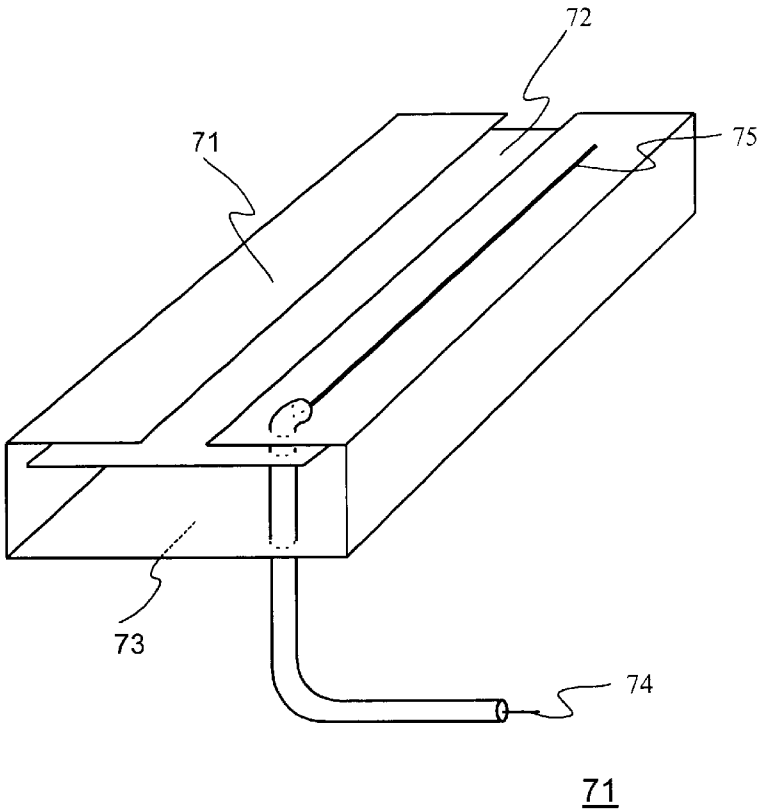
FIGS. 7A–7B are pictorial diagrams illustrating a perspective view and a cross-section view, respectively, of a third drive configuration of the cylinder-like antenna shown in FIG. 6 for exciting a circular current distribution with a double parallel plate seam in accordance with the present invention.
Figure 7B:
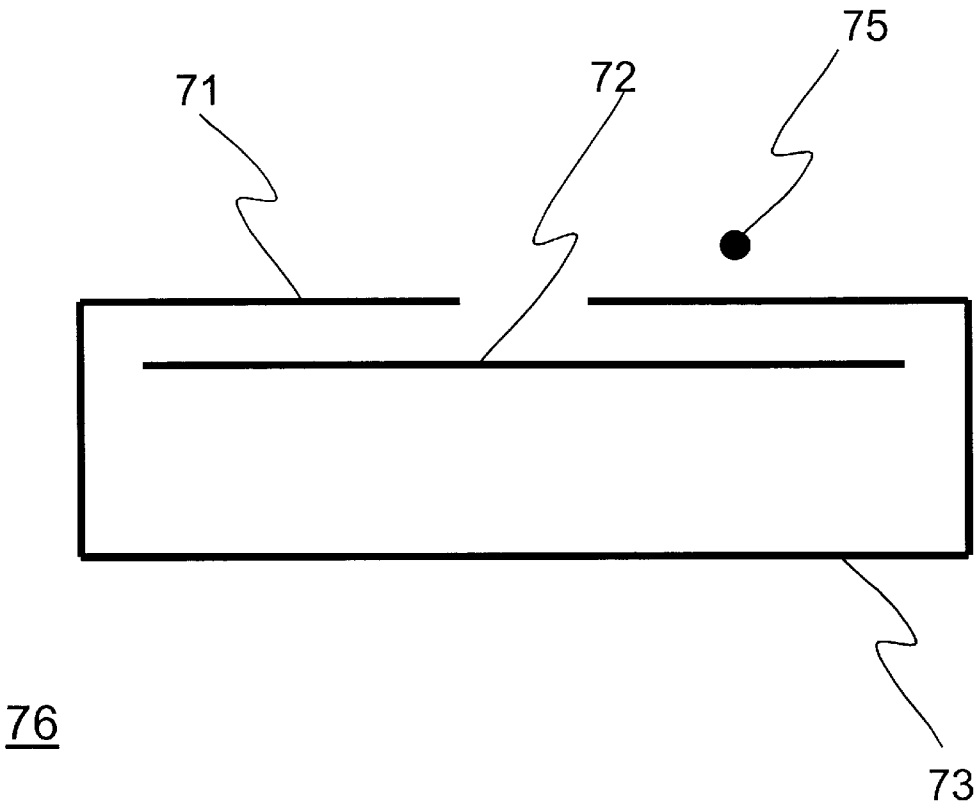

FIG. 6 is a pictorial diagram 60, a perspective view illustrating the second embodiment of a seam configuration in a rectangular cylindrical sheet antenna. A first hole 61 is positioned in the front of the pictorial diagram 60, while a second hole 62 is positioned at the back of the pictorial diagram 60. The rectangular cylindrical sheet antenna may be driven in a number of different ways. A possible approach is to place a wire parallel to the long axis, but off-center to drive currents across the slot. FIG. 7A is a pictorial diagram 70 illustrating this, the second type of drive configuration (of the third seam example, illustrated in FIG. 6) for the rectangular cylindrical sheet antenna. A co-axial feed cable 74 extends and connects through a third plate 73, a second plate 72, and a first plate 71, to an off-center drive wire 75. FIG. 7B is a pictorial diagram 76 illustrating a side view of this second type of drive configuration. A drive wire 77 is shown in cross-section in FIG. 7B.

Figure 8:
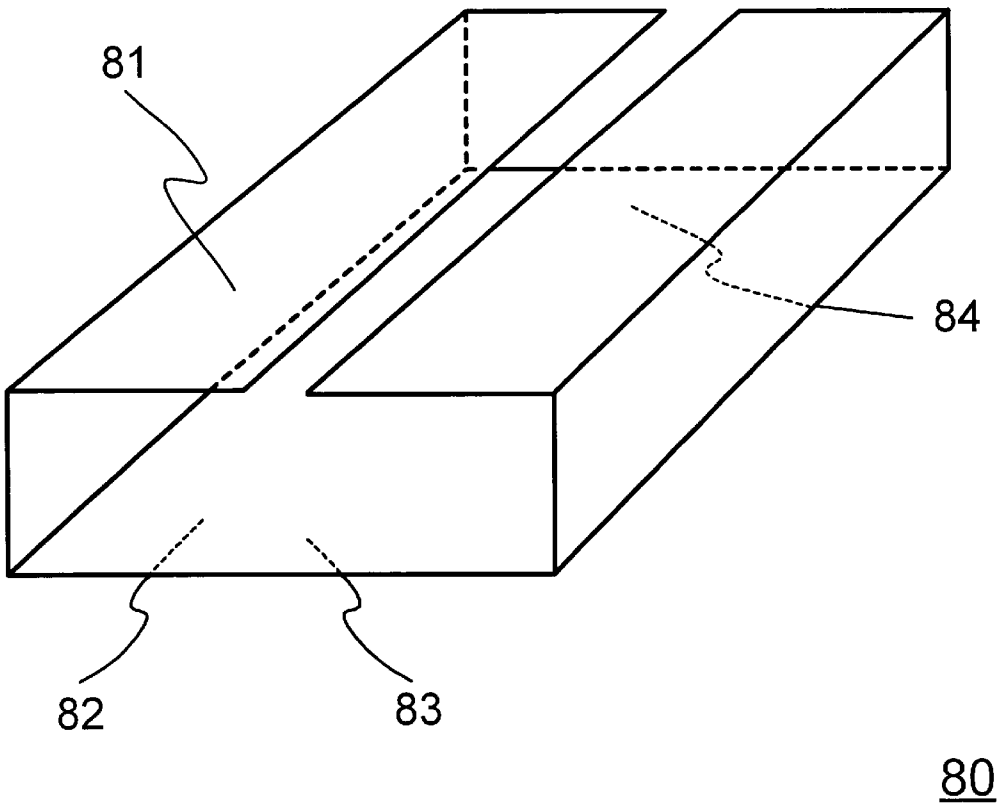
FIG. 8 is a pictorial diagram illustrating a third embodiment of a magnetic dipole sheet antenna having two holes at the ends, with a slot seam between the two holes, allowing a circular current distribution in accordance with the present invention.

FIG. 8 is a pictorial diagram 80 illustrating a third embodiment of a rectangular cylindrical sheet antenna with a slot seam for producing a magnetic dipole current distribution. The pictorial diagram 80 will not operate at as low a frequency as the spiral sheet structure, all other things being equal, since the capacitance of a slot seam is less than the capacitance of the over-lapping sheets in the spiral sheet structure.

Figure 9A:
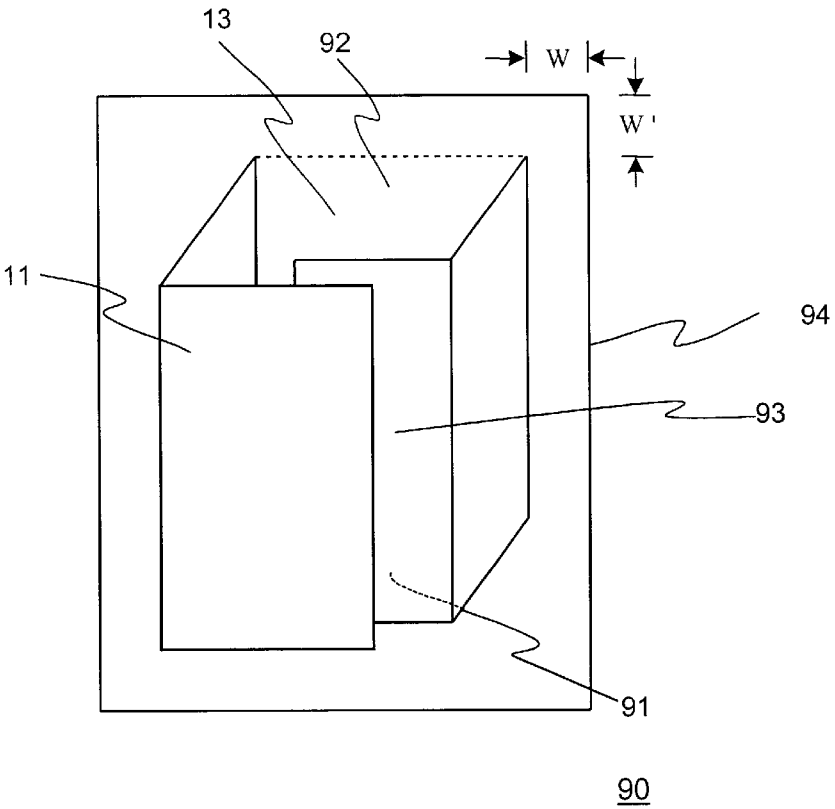
FIGS. 9A–9B are pictorial diagrams illustrating a perspective view and a side cross-section view, respectively, of a first embodiment of a shielded spiral sheet antenna having two holes at the ends and an overlapping seam between the holes, providing shielding from absorbers adjacent to the antenna.
Figure 9B:
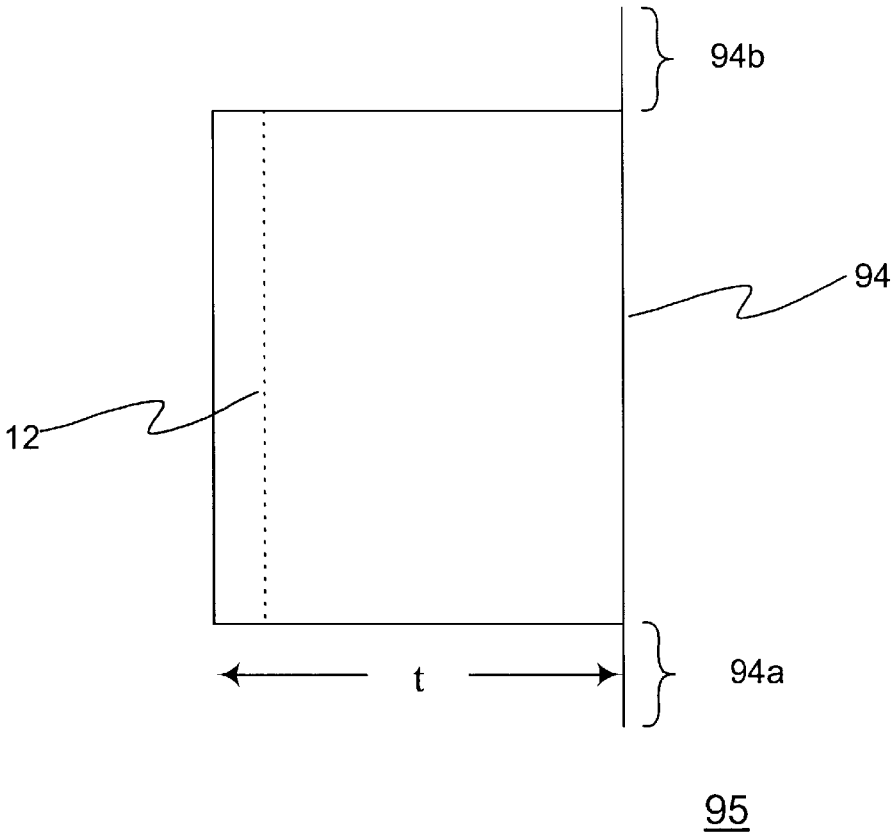

FIG. 9A is a pictorial diagram illustrating a perspective view, and FIG. 9B illustrating a side view, of a first embodiment of a shielded spiral sheet antenna 90 for producing a cylinder-like current distribution. The structure in the shielded spiral sheet antenna 90 is similar to the structure in the spiral sheet antenna 20. A first hole 91 is at one end of the rectangle, and a second hole 92 is at the other end of the rectangle. An over-lapping seam 93, connects the two holes together. In the case of a cellphone the pair of holes 91 and 92 is positioned to face away from a user's ear. A base plate 94, of the shielded spiral sheet antenna 90, is positioned facing the human body, extending 94*a* beyond the third plate 13 at one end and extending 94*b* beyond the third plate 13 at the other end. The shielded spiral sheet antenna 90 therefore faces away from the human body. The width of the border w and w' determines the degree of front-to-back shielding ratio. If $w \approx t$ and $w' \approx t$, then a shielding ratio of 3 dB or better can be achieved.

Figure 10A:
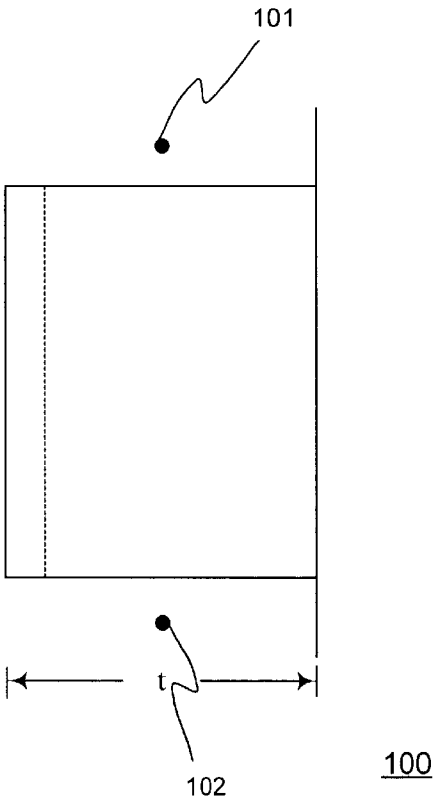
FIGS. 10A–10B are pictorial diagrams illustrating side views of an operational mathematical technique for determining shielding effectiveness in a shield spiral sheet antenna in accordance with the present invention.
Figure 10B:
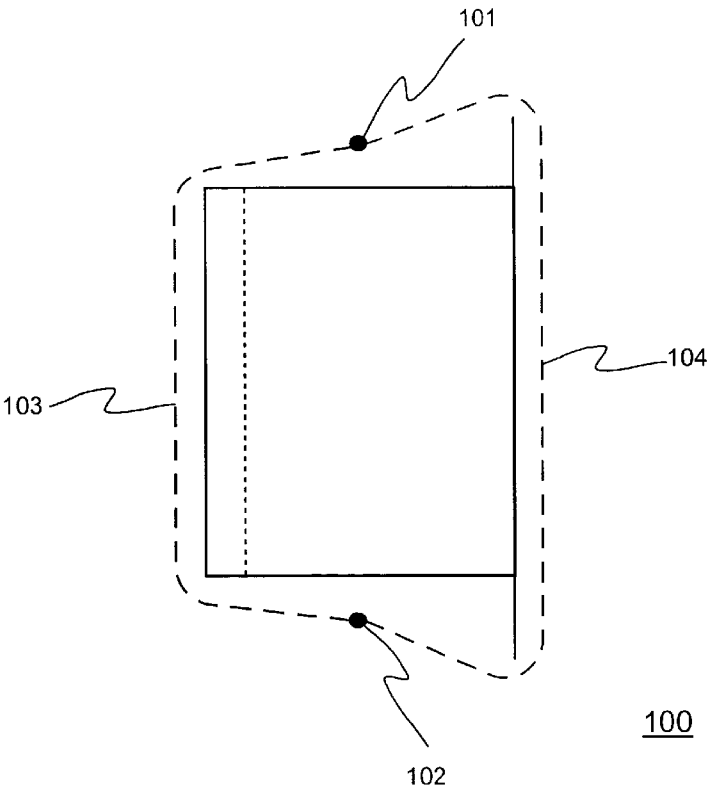

FIGS. 10A and 10B are pictorial diagrams illustrating side views of a operational mathematical technique for defining a shielded spiral sheet antenna. To define the shielded spiral sheet antenna 100, two center points are chosen, a geometrical center point of a top opening 101 and a geometrical center point of a bottom opening 102. A path 103, $L_s$, represents the shortest path between the geometrical center point of a top opening 101 and the geometrical center point of a bottom opening 102 on the short side. A path 104, $L_e$, represents the longest path between the geometrical center point of a top opening 101 and the geometrical center point of a bottom opening 102 on the longer side. The path 103 is shorter than the path 104 that faces a user.

The mathematical relationship between the different variables should be governed by the following inequality, $L_s - L_e > \alpha t$, Eq. (1), in order to provide a good shielding, front-to-back. A value of $\alpha \approx 1$ provides some good degree of shielding.

Figure 11:
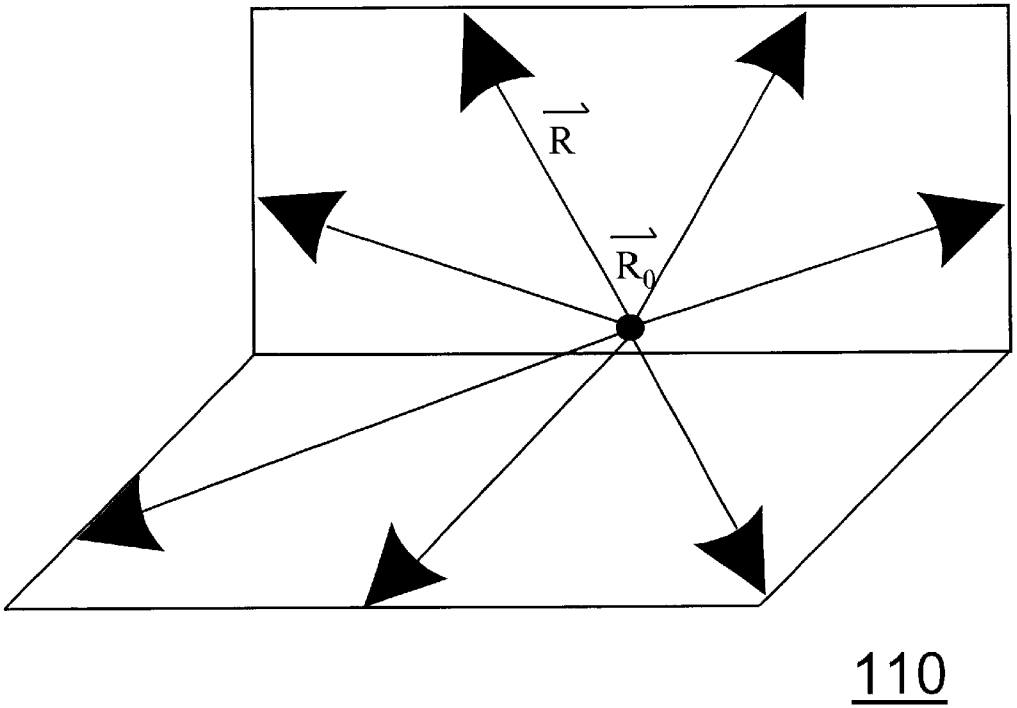
FIG. 11 is a pictorial diagram illustrating an operational procedure for determining the center of a hole in a shielded spiral sheet antenna in accordance with the present invention.

FIG. 11 is a pictorial diagram 110 illustrating an operational procedure for determining the center of a hole for the purposes of our operational mathematical technique for defining a shielded spiral antenna. The geometrical center of the top and bottom openings can be defined as a type of geometrical "center-of-gravity":

$$\sum_{\substack{edges\ of \\ opening}} (\overline{R} - \overline{R}_0) = 0 \qquad \text{Eq. (2)}$$

where $\overline{R}$ is the set of position vectors at the edges of the opening, and $\overline{R}_0$ is the center-of-gravity center point that satisfies the Eq. (2).

This equation defines the center point for use in the mathematical specification in Eq (1). The point around which all the vectors sum to zero, defines the center of the hole, or opening. The type of metallic shielding specified FIGS. 9A, 9B, 10A, and 10B, are useful for shielding cell phone antennas from the user.

Figure 12A:
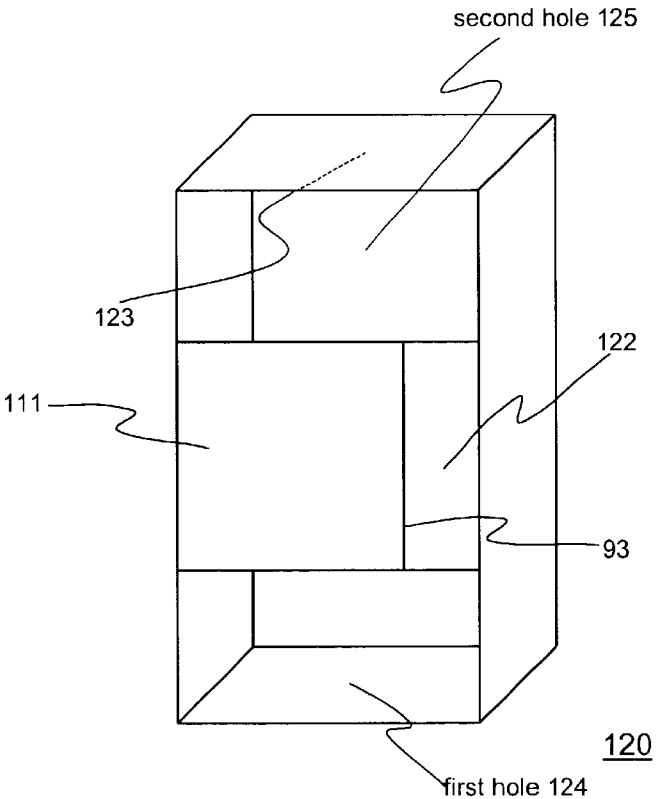
FIGS. 12A–12B are pictorial diagrams illustrating a second embodiment of a shielded spiral sheet antenna with overlapping capacitive seam structure in accordance with the present invention.

FIG. 12A is a pictorial diagram 120 illustrating a perspective view of a second embodiment of a shielded spiral sheet antenna (with overlapping capacitive structure). A first hole 124 and a second hole 125 are positioned to face away from the user. In effect, both the first and second holes 124 and 125 are facing the front. A seam 126 connects between the first hole 124 and the second hole 125.

Figure 12B:
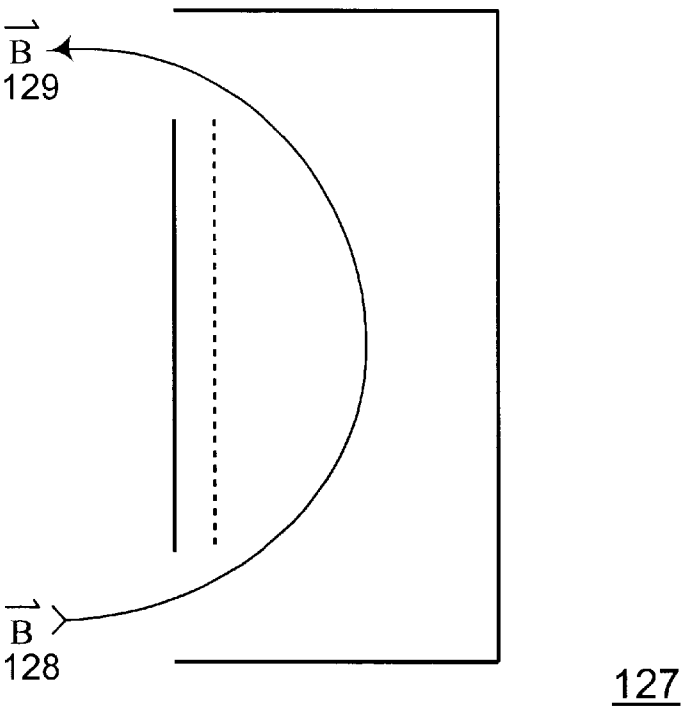

FIG. 12B is a pictorial diagram 127 illustrating a side cross-sectional view of FIG. 12A, with AC magnetic field illustrated. The structure diagram has two holes for the magnetic field entering 128 and exiting 129 the antenna. The rectangular openings shown, may be smaller than the width of the rectangle. A rectangular container is intended as an illustration. The rectangular container may be in a shape resembling a cell phone body instead.

Figure 13:
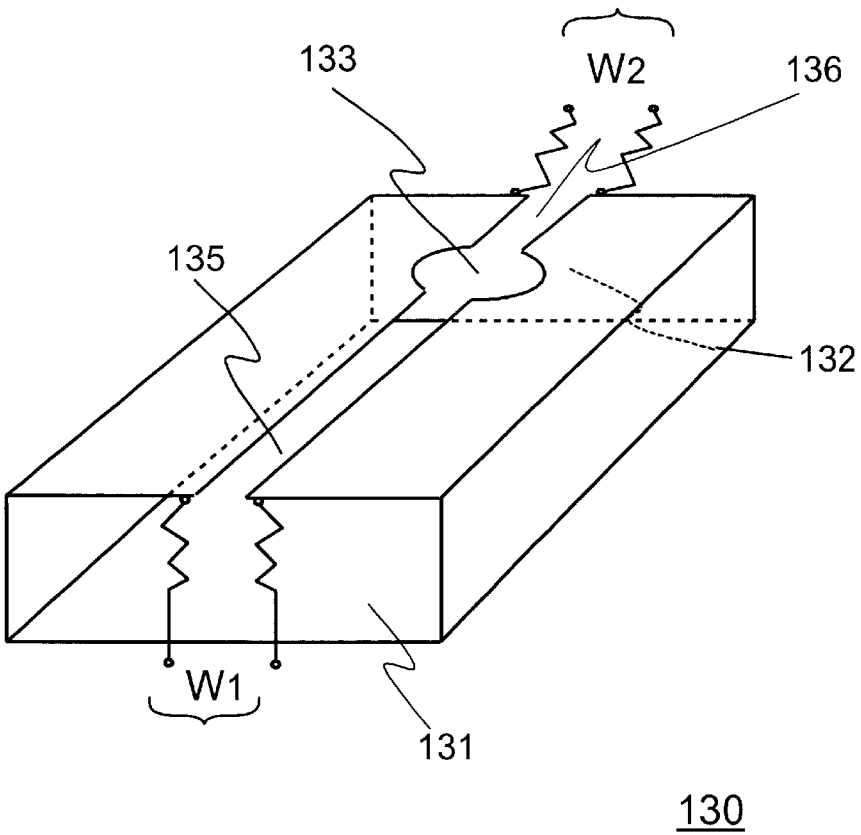
FIG. 13 is a pictorial diagram illustrating a multi-frequency, multi-tap antenna with spring contacts W1 and W2 in accordance with the present invention.

FIG. 13 is a pictorial diagram illustrating a dual frequency, dual-tap antenna 130 with a first hole 131, a second hole 132, and a third hole 133. A first seam 135 connects between the first hole 131 and the third hole 133. A second seam 136 connects between the hole 132 and the hole 133. Spring contacts $w_1$ and $w_2$ can connect to different circuits on a circuit board, such as for operating with main cell phone bands including Personal Communication System (PCS) at 1900 MHz, Global Positioning Systems (GPS) at 1575 MHz, bluetooth, Advanced mobile phone system (amps) at 850 MHz, and 900 MHz cell phone bands. The spring contacts are only an example. The concept is to use multiple taps for the different frequencies that might be needed in a wireless system. The multi-taps would be derived from a single antenna structure.

In general, the antenna structure consists of a metallic enclosure, with holes, or openings. For each independent antenna, or for each frequency band, an additional hole or opening must be provided on the metallic enclosure. For the example in FIG. 13, two frequencies, require 3 holes. Likewise n-frequencies would require (n+1) holes or openings, connected by n seams. Some of the n-frequencies might be identical, for the purpose of space or polarization diversity.

Figure 14:
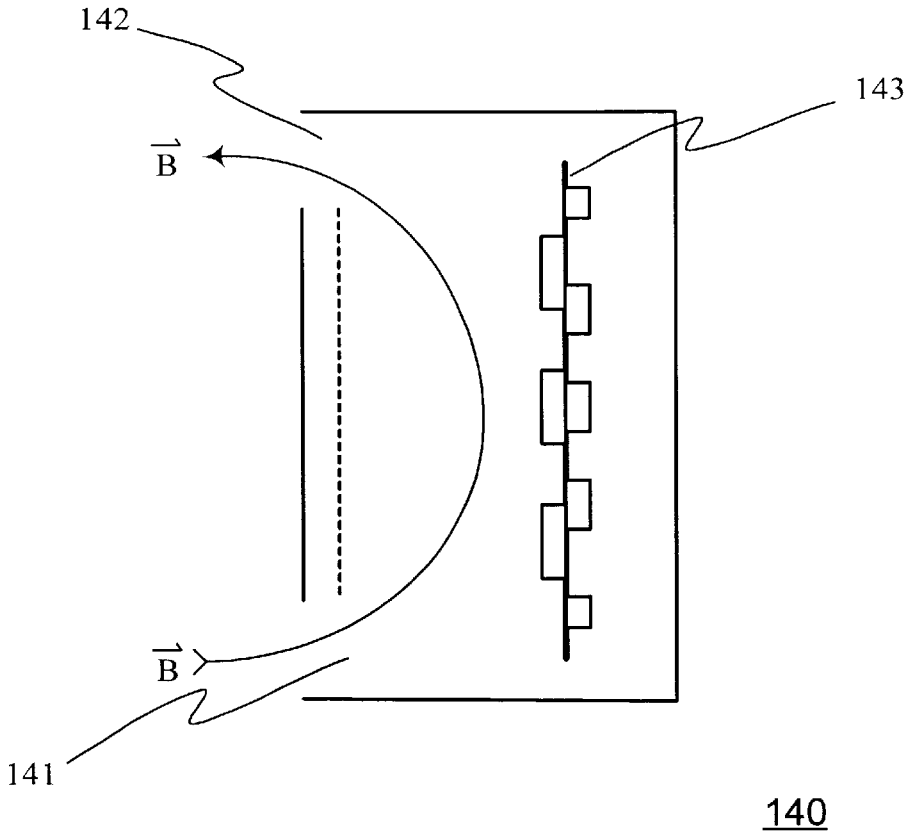
FIG. 14 is a pictorial diagram illustrating the placement of internal circuit boards inside an antenna in accordance with the present invention.

FIG. 14 is a pictorial diagram 140 illustrating the placement of one or more internal circuit boards 143 inside an antenna. Radio Frequency Magnetic fields enter a first hole 141 and exit through a second hole 142. The internal volume in an antenna can be wisely utilized as not to waste any unused empty space. The extra space can be filled with one or more active circuit boards 143 for operation of a cell phone. The internal circuit boards do not interfere much with the internal AC RF magnetic fields inside the antenna structure. This allows the antenna volume to be put to good use in a small volume cell phone.

The above embodiments are only illustrative of the principles of this invention and are not intended to limit the invention to the particular embodiments described. For example, the basic concept in this invention teaches a metallic structure with at least two holes, and a seam. One of ordinary skill in the art should recognize that any type of antenna structure, which possesses these types of characteristics, is within the spirit of the present invention. Furthermore, although the term "holes" are used, it is apparent to one of ordinary skill in the art that other similar or equivalent concepts may be used, such as opening, gaps, spacing, etc. Accordingly, various modifications, adaptations, and combinations of various features of the described embodiments can be practiced without departing from the scope of the invention as set forth in the appended claims.

We claim:

1. An antenna, comprising:

a metallic structure with two or more openings that are on the same side of the metallic structure, at least one seam connecting between the two or more openings; and one or more metal sheets, coupled to the metallic structure, for providing radio shielding.

2. The antenna of claim 1, wherein the at least one seam comprises a capacitive structure.

3. The antenna of claim 1, further comprising a pair of wires coupled to the antenna, the pair of wires providing energy to the antenna.

4. The antenna of claim 1, further comprising a wire and a ground, the wire and the ground coupled to the antenna for providing energy to the antenna.

5. The antenna of claim 1, wherein an electrical length of the antenna is less than one-quarter wavelength.

6. An antenna, comprising:

a metallic structure with two or more openings;

at least one seam connecting between the two or more openings; and one or more metal sheets, coupled to the metallic structure, for providing radio shielding, wherein a first of the two or more openings has a first direction pointing from inside to outside of the metallic structure and a second of the two or more openings has a second direction pointing from inside to outside of the metallic structure, the first direction being the same as the second direction.

7. An antenna, comprising:

a metallic structure with two or more openings, at least one seam connecting between the two or more openings; and one or more metal sheets, coupled to the metallic structure, for providing radio shielding, wherein the at least one seam comprises a capacitive structure of a spiral sheet type.

8. An antenna, comprising:

a metallic structure with two or more openings, the metallic structure including two planar surfaces on a plane;

at least one seam connecting between the two or more openings, and one or more metal sheets, coupled to the metallic structure, for providing radio shielding, wherein the at least one seam comprises a capacitive structure of a slot type formed by two planar surfaces of the metallic structure themselves, the two planar surfaces being on a plane.

9. The antenna of claim 8, wherein the at least one seam comprises:

a capacitive structure of a double parallel plate type, a first parallel plate being formed by the two surfaces of the metallic structure themselves, the two surfaces being on a plane, and a second plate parallel to the plane.

* * * * *